US005479954A

United States Patent [19]

Lin

[11] Patent Number: 5,479,954

[45] Date of Patent: Jan. 2, 1996

[54] FOLDABLE TENT

[76] Inventor: Tu Lin, No. 138-2, Ta-Chieh Rd., Ching-Shui Chen, Taichung Hsien, Taiwan

[21] Appl. No.: 357,180

[22] Filed: Dec. 13, 1994

[51] Int. Cl.[6] ..... E04H 15/28

[52] U.S. Cl. ..... 135/98; 135/27

[58] Field of Search ..... 135/22–24, 27, 135/98, 97

[56] References Cited

U.S. PATENT DOCUMENTS

| | | | |
|---|---|---|---|
| 420,690 | 2/1890 | Linke | 135/24 X |
| 580,907 | 4/1897 | Stevenson | 135/24 |
| 1,680,090 | 8/1928 | Cullman | 135/22 X |
| 2,864,389 | 12/1958 | Smith et al. | 135/98 |
| 3,874,397 | 4/1975 | Oberhaus | 135/98 |
| 4,033,366 | 7/1977 | Forget | 135/98 |
| 5,117,851 | 6/1992 | Chang | 135/98 |
| 5,216,948 | 6/1993 | Sheppard et al. | 135/98 X |

FOREIGN PATENT DOCUMENTS

| | | | |
|---|---|---|---|
| 570251 | 2/1959 | Canada | 135/24 |

*Primary Examiner*—Lanna Mai

*Attorney, Agent, or Firm*—Birch, Stewart, Kolasch & Birch

[57] ABSTRACT

A foldable tent includes a canopy and a collapsible frame assembly for stretching the canopy. The frame assembly includes a crown, a plurality of curved rib units, a slider and a plurality of stretcher members. The crown has a vertically extending passageway formed therethrough. The curved rib units have upper ends pivoted to and around the crown, and lower ends fastened to the periphery of the canopy. The slider has a base member and a retainer which extends upwardly from the base member. The retainer is extensible to pass through the passageway when the frame assembly is collapsed, and is engageable with the crown when the retainer expands. The stretcher members have first ends pivoted to and around the base member, and second ends pivoted respectively to the rib units for supporting the rib units to stretch the canopy. The stretcher members are connected to one another to form a reinforcement network for supporting the rib units.

8 Claims, 7 Drawing Sheets

FOLDABLE TENT

BACKGROUND OF THIS INVENTION

1. Field of the Invention

This invention relates to a tent, more particularly to a foldable tent which can be easily collapsed and carried.

2. Description of the Related Art

The improvement of this invention is directed to a conventional tent, as shown in FIG. 1, which includes several joints 1, several support poles 2, a canopy 3 and four base members 4.

When assembling the conventional tent, four of the support poles 2 have to be erected respectively and vertically on the base members 4. The remaining support poles 2 are mounted successively on the top ends of the four upright support poles 2 and are connected to one another by means of joints 1 to form a frame for supporting and stretching the canopy 3. The canopy 3 has four elongated flaps (3*a*) which extend downward along the erected support poles 2 respectively, and four binding elements (3*b*) which are secured respectively to the distal ends of the flaps (3*a*). Each of the base member 4 has a retainer (4*a*) secured thereto so that the binding elements (3*b*) can be tied respectively to the retainers (4*a*) in order to fasten the flaps (3*a*) respectively to the base members 4, thereby covering the erected support poles 2. In this way, the conventional tent is constructed. A table-and-chair assembly 5 can be disposed within the conventional tent for users.

Since the conventional tent includes numerous separate parts, at least two persons are needed to assemble or disassemble the conventional tent. Accordingly, it is quite inconvenient for only one person to install or dismantle the conventional tent, and it is also quite inconvenient to carry these separate parts during camping. In addition, the support poles 2 cannot support effectively and firmly the canopy 3 against a violent storm.

SUMMARY OF THE INVENTION

Therefore, the main objective of this present invention is to provide a foldable tent which has a collapsible frame assembly that can be collapsed easily by only one person during camping. The tent can be carried conveniently and can effectively and firmly support the canopy of the foldable tent against a violent storm.

According to this invention, a foldable tent includes a canopy and a collapsible frame assembly for stretching the canopy. The frame assembly includes a crown, a plurality of curved rib units, a slider and a plurality of stretcher members.

The crown has a vertically extending passageway formed therethrough. The curved rib units have upper ends pivoted to and around the crown, and lower ends fastened to the periphery of the canopy. The slider has a base member and a retainer which extends upwardly from the base member. The retainer is extensible to pass through the passageway when the frame assembly is collapsed, and is engageable with the crown when the frame assembly is stretched. The stretcher members have first ends which are pivoted to and around the base member, and second ends which are pivoted respectively to the rib units for supporting the rib units to stretch the canopy.

Each of the stretcher members has two branch elements which have first end portions merged together towards and pivoted to the base member of the slider, second end portions merged together towards and pivoted to a respective one of the rib units, and intermediate portions curved and spaced apart from each other. The intermediate portions of the branch elements of each of the stretcher members contact and are connected to the intermediate portions of any adjacent two of the branch elements, respectively. Accordingly, the stretcher members together form a reinforcement network for the rib units.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
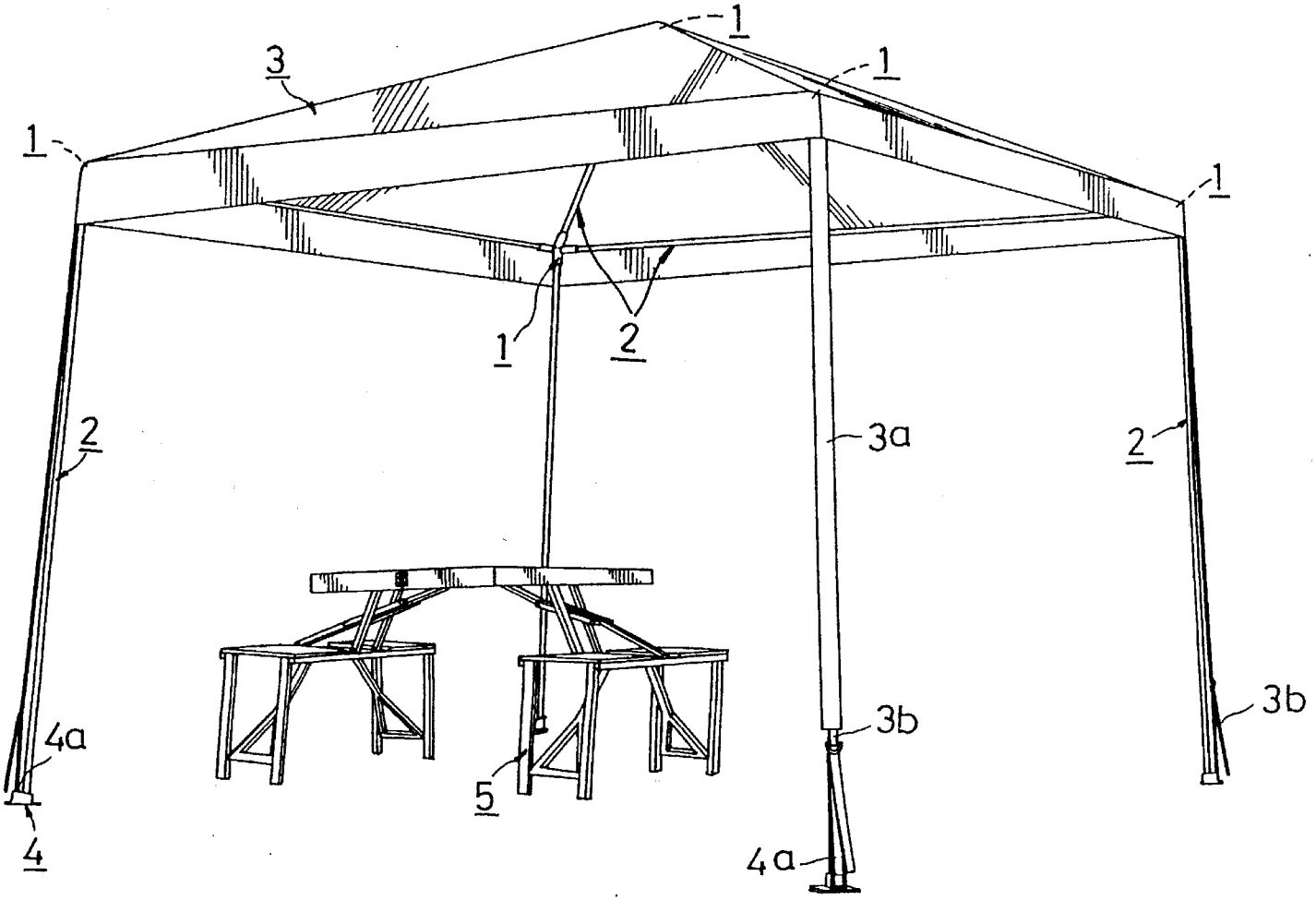
FIG. 1 PRIOR ART
FIG. 1 i a perspective view of a conventional tent.
Figure 2:
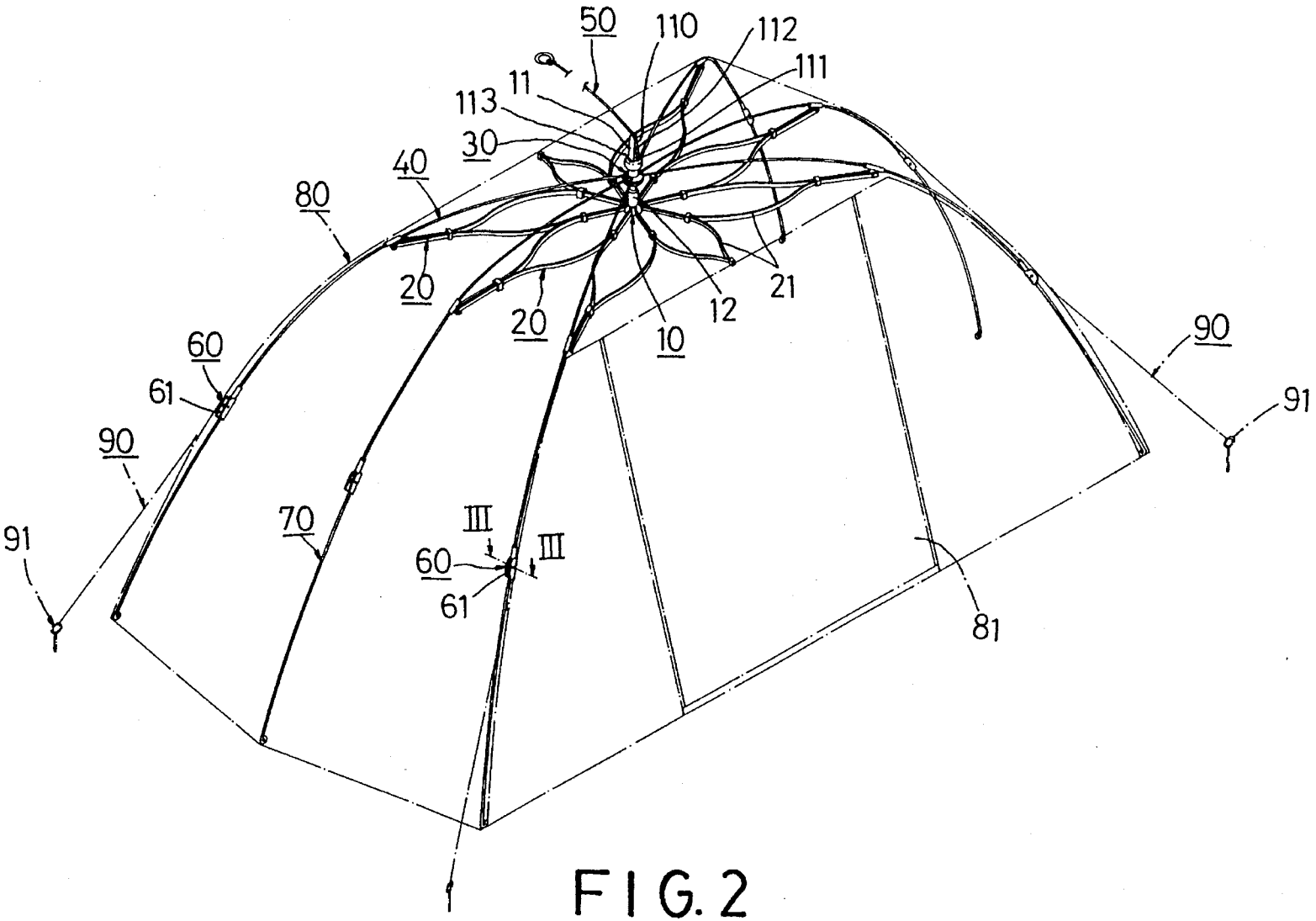
FIG. 2 is a perspective view showing a foldable tent according the preferred embodiment of this invention.
Figure 4:
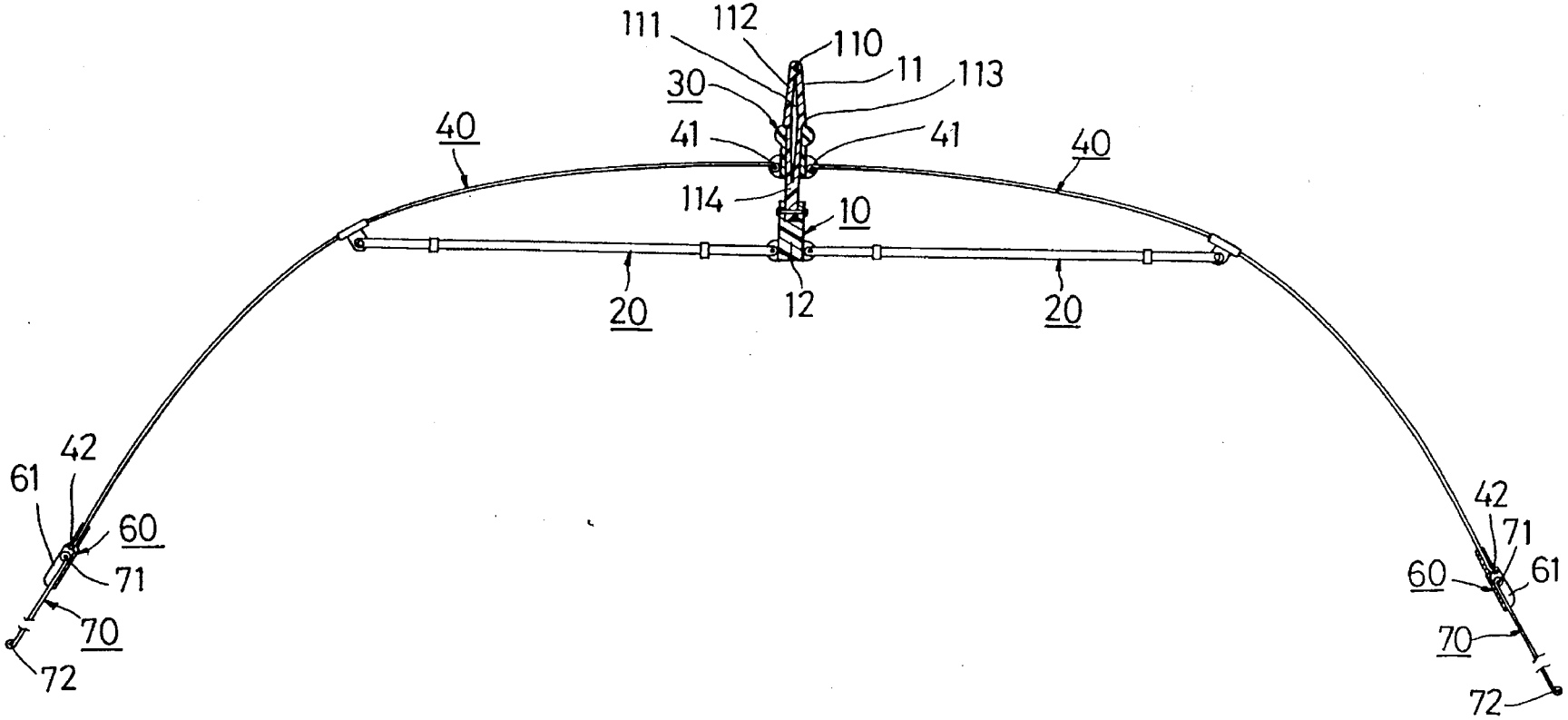
FIG. 4 is a schematic view illustrating how the foldable tent is stretched in accordance with this invention.

Referring to FIGS. 2 and 4, the preferred embodiment of a foldable tent according to this invention includes a canopy 80 (see FIG. 2) and a collapsible frame assembly for stretching the canopy 80. The frame assembly includes a slider 10, a plurality of stretcher members 20, a crown 30 and a plurality of curved rib units for supporting the canopy 80. The canopy 80 has a zippered door 81 mounted thereon (see FIG. 2).

The crown 30 has a vertically extending passageway 31 (see FIG. 6) formed therethrough.

Figure 3:
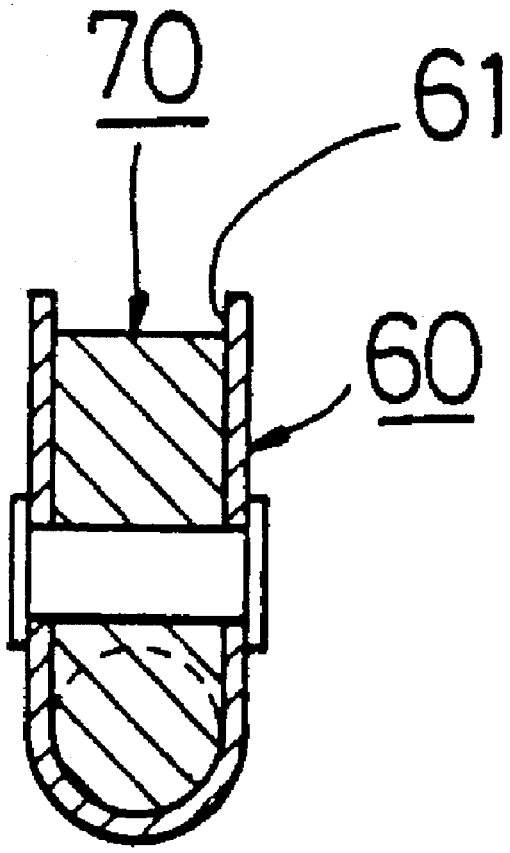
FIG. 3 is a sectional view, taken along line III—III of FIG. 2, showing one of the joints of the foldable tent of this invention.
Figure 6:
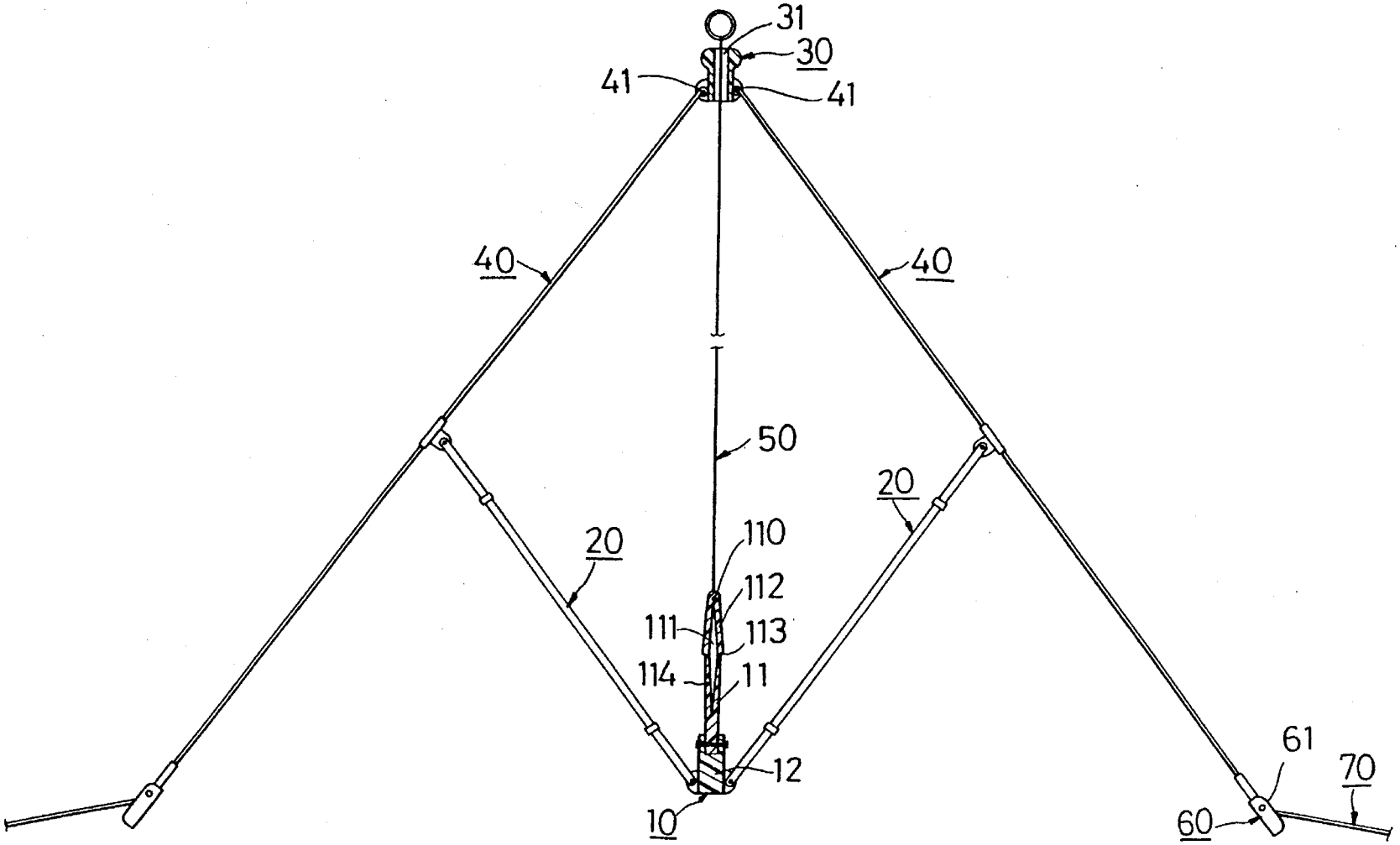
FIG. 6 is a schematic view illustrating how the foldable tent is collapsed in accordance with this invention.
Figure 7:
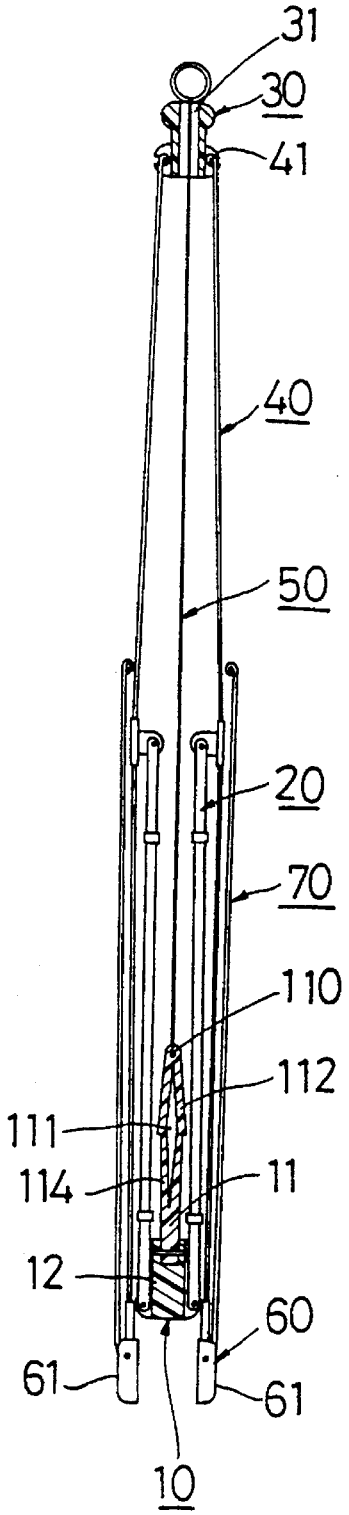
FIG. 7 is a schematic view illustrating the collapsed foldable tent in accordance with this invention.

Each of the curved rib units has flexible upper and lower ribs 40, 70 which are used for supporting the canopy 80, and a joint 60 for interconnecting the upper and lower ribs 40, 70. The upper ribs 40 have upper ends 41 pivoted to and around the outer peripheral surface of the crown 30, and lower ends 42 with outwardly-bent portions mounted respectively within the joints 60 in order to prevent rotation of the joint 60 relative to the upper rib 40, thereby positioning effectively the joints 60 on the lower ends 42 of the upper ribs 40. The lower ribs 70 have upper ends 71 mounted respectively and pivotally within the joints 60, and lower ends 72 fastened to the periphery of the canopy 80. Each of the joints 60 has a U-shaped cross section (see FIG. 3) for defining an opening 61 which can allow upward turning of a respective one of the lower rib 70 about the corresponding joint 60 when the frame assembly of the foldable tent is to be collapsed, as shown in FIGS. 6 and 7.

Referring again to FIG. 4, the upper ends 41, 71 of the upper and lower ribs 40, 70 can be bent to form loops for facilitating pivotal mounting of the upper ends 41, 71 on the crown 30 and the joints 60.

Each of the rib units further includes a positioning cord 90, as shown in FIG. 2, which has one end thereof secured to a respective one of the upper ribs 40 adjacent to the corresponding joint 60, and another end thereof tied with a positioning nail 91 that can be fixed releasably to the ground when the foldable tent is in use so as to further position firmly the foldable tent on the ground.

Referring again to FIGS. 2, 4 and 6, the slider 10 is made integrally from plastic material, and includes a base member 12 and a retainer 11 which extends upwardly from the base member 12. The retainer 11 is extensible to pass through the passageway 31 of the crown 30 when the frame assembly is to be collapsed, as shown in FIG. 6. The retainer 11 is engageable with the crown 30 when the frame assembly is stretched, as shown in FIG. 4.

Referring again to FIG. 2, the stretcher members 20 are made of medium-carbon steel in a known manner and have first ends pivoted to and around the base member 12 of the slider 10, and second ends pivoted respectively to the upper ribs 40 for supporting the rib units to stretch the canopy 80. Each of the stretcher members 20 has two branch elements 21 which have first end portions merged together towards and pivoted to the base member 12, second end portions merged together towards and pivoted to a respective one of the upper ribs 40, and intermediate portions curved and spaced apart from each other. The intermediate portions of the branch elements 21 of each of the stretcher members 20 contact and are connected to the intermediate portions of any adjacent two of the branch elements 21, respectively, so as to form a petal-like reinforcement network for supporting the rib units.

Figure 5:
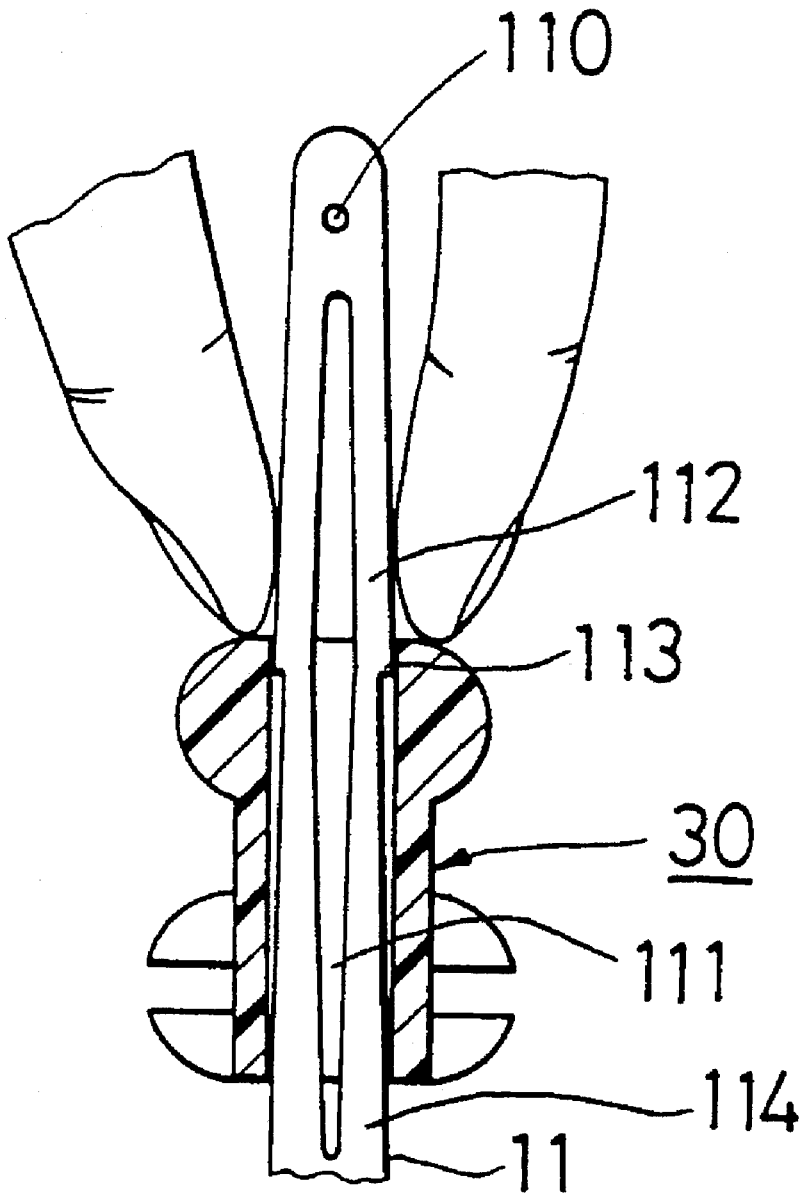
FIG. 5 is a schematic view illustrating how a retainer of the foldable tent is compressed manually in accordance with this invention.

Referring again to FIGS. 4 and 6, the retainer 11 is an elongated hollow stem which has a distal portion 112, a proximal portion 114 relative to the base member 12, and an annular shoulder 113 that is formed between the distal and proximal portions 112, 114. The distal portion 112 diverges toward the shoulder 113. The proximal portion 114 diverges toward the shoulder 113. The hollow stem has a slot 111 which is formed diametrically therethrough and which extends a predetermined distance from the proximal portion 114 to the distal portion 112 for permitting compression of the hollow stem. The shoulder 113 forms an anchor which engages the crown 30 when the hollow stem expands for positioning the hollow stem on the crown 30, as shown in FIG. 4, and which extends through the passageway 31 when the hollow stem is compressed manually (see FIG. 5) for allowing downward movement of the hollow stem away from the crown 30, as shown in FIG. 6. In this way, the frame assembly can be collapsed, as shown in FIG. 7.

The frame assembly further includes a pull cord 50 which has one end thereof extending through a hole 110 (see FIG. 6) of the distal portion 112 of the hollow stem so as to fasten the pull cord 50 to the distal portion 112. The pull cord 50 extends through the passageway 31 of the crown 30 and has another end thereof tied with a loop so as to facilitate grasping of the pull cord 50 by a user for pulling the slider 10 toward the crown 30 when it is desired to stretch the frame assembly.

It is noted that the foldable tent can be stretched or collapsed easily by only one person by the above-described manner. Accordingly, it is quite convenient for the user to assemble the foldable tent during camping. In addition, the parts required for the foldable tent are connected to one another. Accordingly, it is quite convenient for the user to carry the collapsed foldable tent. Preferably, the stretcher members 20 arranged in the petal-like reinforcement network can support firmly the rib units against a violent storm when the foldable tent is in use.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangement.

I claim:

1. A foldable tent including a canopy and a collapsible frame assembly for stretching said canopy, wherein said frame assembly comprises:

a crown having a vertically extending passageway formed therethrough;

a plurality of curved rib units having upper ends pivoted to and around said crown, and lower ends fastened to a periphery of said canopy;

a slider having a base member and a retainer extending upwardly from said base member, said retainer being extensible to pass through said passageway when said frame assembly is collapsed, and being engageable with said crown when said frame assembly is stretched;

a plurality of stretcher members having first ends pivoted to and around said base member of said slider, and second ends pivoted respectively to said rib units for supporting said rib units to stretch said canopy, said stretcher members being connected to one another to form a reinforcement network for supporting said rib units; and said retainer being an elongated hollow stem having a distal portion, a proximal portion relative to said base member, and an annular shoulder that is formed between said distal portion and said proximal portion, said distal portion diverging toward said shoulder, said proximal portion diverging toward said shoulder, said hollow stem having a slot which is formed diametrically therethrough and extending a predetermined distance from said proximal portion to said distal portion for permitting compression of said hollow stem, said shoulder forming an anchor which engages said crown when said hollow stem expands for positioning said hollow stem on said crown, and extending through said passageway of said crown when said stem is compressed for allowing downward movement of said hollow stem away from said crown so as to collapse said frame assembly.

2. The foldable tent according to claim 1, wherein each of said stretcher members has two branch elements having first end portions merged together towards and pivoted to said base member of said slider, second end portions merged together towards and pivoted to a respective one of said rib units, and intermediate portions curved and spaced apart from each other, said intermediate portions of said branch elements of each of said stretcher members contacting and being connected to said intermediate portions of any adjacent two of said branch elements, respectively, to form said reinforcement network.

3. The foldable tent according to claim 1, wherein each of said curved ribs includes a lower rib and an upper rib and further including a joint for connecting said lower rib to said upper rib relative to each other.

4. The foldable tent according to claim 1, wherein said joint is formed in a U-shaped configuration for defining an opening for enabling selective upward turning of a respective lower rib about a corresponding joint.

5. A foldable tent including a canopy and a collapsible frame assembly for stretching said canopy, wherein said frame assembly comprises:

a crown having a vertically extending passageway formed therethrough;

a plurality of curved rib units having upper ends pivoted to and around said crown, and lower ends fastened to a periphery of said canopy;

a slider having a base member and a retainer extending upwardly from said base member, said retainer being extensible to pass through said passageway when said frame assembly is collapsed, and being engageable with said crown when said frame assembly is stretched;

a plurality of stretcher members having first ends pivoted to and around said base member of said slider, and second ends pivoted respectively to said rib units for supporting said rib units to stretch said canopy, said stretcher members being connected to one another to form a reinforcement network for supporting said rib units;

said retainer being an elongated hollow stem having a distal portion, a proximal portion relative to said base member, and an annular shoulder that is formed between said distal portion and said proximal portion, said distal portion diverging toward said shoulder, said proximal portion diverging toward said shoulder, said hollow stem having a slot which is formed diametrically therethrough and extending a predetermined distance from said proximal portion to said distal portion for permitting compression of said hollow stem, said shoulder forming an anchor which engages said crown when said hollow stem expands for positioning said hollow stem on said crown, and extending through said passageway of said crown when said stem is compressed for allowing downward movement of said hollow stem away from said crown so as to collapse said frame assembly; and a pull cord having one end thereof connected securely to said distal portion of said hollow stem, said pull cord extending through said passageway of said crown so as to facilitate pulling of said hollow stem toward said crown.

6. The foldable tent according to claim 5, wherein each of said stretcher members has two branch elements having first end portions merged together towards and pivoted to said base member of said slider, second end portions merged together towards and pivoted to a respective one of said rib units, and intermediate portions curved and spaced apart from each other, said intermediate portions of said branch elements of each of said stretcher members contacting and being connected to said intermediate portions of any adjacent two of said branch elements, respectively, to form said reinforcement network.

7. The foldable tent according to claim 5, wherein each of said curved ribs includes a lower rib and an upper rib and further including a joint for connecting said lower rib to said upper rib relative to each other.

8. The foldable tent according to claim 7, wherein said joint is formed in a U-shaped configuration for defining an opening for enabling selective upward turning of a respective lower rib about a corresponding joint.

* * * * *